US007405998B2

(12) United States Patent
Webb et al.

(10) Patent No.: US 7,405,998 B2
(45) Date of Patent: Jul. 29, 2008

(54) METHOD AND APPARATUS FOR GENERATING FLUID PRESSURE PULSES

(75) Inventors: Earl D. Webb, Wilson, OK (US); Iosif J. Hriscu, Duncan, OK (US); Perry Courville, Houston, TX (US); Robert Pipkin, Marlow, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 611 days.

(21) Appl. No.: 11/142,864

(22) Filed: Jun. 1, 2005

(65) Prior Publication Data

US 2006/0272821 A1 Dec. 7, 2006

(51) Int. Cl.
*E21B 47/18* (2006.01)

(52) U.S. Cl. ..... 367/84; 166/249; 166/263; 166/104; 166/177.6; 175/106; 175/107

(58) Field of Classification Search ..... 166/249, 166/263, 104, 278, 177.6; 175/106, 107; 367/82, 84
See application file for complete search history.

(56) References Cited

U.S. PATENT DOCUMENTS

| | | | | |
|---|---|---|---|---|
| 2,780,438 A | | 2/1957 | Bielstein | |
| 3,810,602 A | * | 5/1974 | Parkinson | 251/304 |
| 3,923,099 A | * | 12/1975 | Brandon | 166/249 |
| 4,398,769 A | * | 8/1983 | Jacoby | 299/4 |
| 4,683,951 A | * | 8/1987 | Pathak et al. | 166/271 |
| 4,718,490 A | * | 1/1988 | Uhri | 166/281 |
| 4,830,122 A | | 5/1989 | Walter | 175/106 |
| 4,919,204 A | | 4/1990 | Baker et al. | 166/223 |
| 5,297,631 A | | 3/1994 | Gipson | 166/299 |
| 5,484,016 A | | 1/1996 | Surjaatmadja et al. | 166/104 |

(Continued)

FOREIGN PATENT DOCUMENTS

EP 0 335 543 10/1989

(Continued)

OTHER PUBLICATIONS

B. Davidson et al., "Laboratory Experiments on Pressure Pulse Flow Enhancement in Porous Media," Proceedings of the CIM Regina Technical Meeting, Oct. 1999.

(Continued)

*Primary Examiner*—Albert K. Wong
(74) *Attorney, Agent, or Firm*—John W. Wustenberg; Baker Botts, L.L.P.

(57) ABSTRACT

Apparatuses and methods for generating fluid pressure pulses are disclosed. An example apparatus may include a chamber that can collect fluid and an upstream ported disc coupled to a downstream end of the chamber. The upstream ported disc may rotate about a central axis. The upstream ported disc includes an upstream eccentric port that rotates about the central axis as the upstream ported disc rotates. The example apparatus may include a downstream ported disc coupled to a downstream end of the upstream ported disc such that the downstream ported disc remains substantially rotationally fixed relative to the upstream ported disc. The downstream ported disc includes a downstream eccentric port that may align with the upstream eccentric port to form a passageway for fluid to exit from the chamber to outside of the apparatus, at some time in a rotation cycle of the upstream ported disc.

20 Claims, 11 Drawing Sheets

U.S. PATENT DOCUMENTS

| | | | | |
|---|---|---|---|---|
| 5,586,602 | A | 12/1996 | Vagin | 166/249 |
| 5,836,389 | A | 11/1998 | Wagner et al. | 166/249 |
| 6,012,521 | A | 1/2000 | Zunkel et al. | 166/249 |
| 6,241,019 | B1 | 6/2001 | Davidson et al. | 166/249 |
| 6,279,670 | B1 | 8/2001 | Eddison et al. | |
| 6,318,468 | B1 * | 11/2001 | Zakiewicz | 166/305.1 |
| 6,336,502 | B1 | 1/2002 | Surjaatmadja et al. | 166/104 |
| 6,405,796 | B1 | 6/2002 | Meyer et al. | 166/249 |
| 6,405,797 | B2 | 6/2002 | Davidson et al. | 166/249 |
| 6,460,618 | B1 | 10/2002 | Braithwaite et al. | 166/249 |
| 6,619,394 | B2 | 9/2003 | Soliman et al. | 166/249 |
| 6,691,778 | B2 | 2/2004 | Cole et al. | 166/249 |
| 6,832,655 | B2 | 12/2004 | Ravensbergen et al. | 166/311 |
| 6,851,473 | B2 * | 2/2005 | Davidson | 166/263 |
| 7,198,105 | B2 * | 4/2007 | Grant et al. | 166/305.1 |
| 2004/0011522 | A1 | 1/2004 | Ivannikov et al. | 166/177.6 |
| 2004/0156265 | A1 | 8/2004 | Lavrut et al. | |
| 2005/0061503 | A1 | 3/2005 | Misselbrook et al. | 166/278 |

FOREIGN PATENT DOCUMENTS

| | | |
|---|---|---|
| WO | WO 00/37776 | 6/2000 |
| WO | WO 01/34937 | 5/2001 |
| WO | WO 02/097238 | 12/2002 |

OTHER PUBLICATIONS

D. Brad Paterson, News Release, Wavefront Energy and Environmental Services, Inc., available at http://www.onthewavefront.com/Files/Press/2003/Technology%20Description.htm, Oct. 14, 2003.

Wavefront Energy & Environmental Services, Inc., "How Does It Work?," available at http://www.onthewavefront.com/ppt_how-does-it-work.htm, undated.

Foreign communication from a related counter part dated May 12, 2006.

* cited by examiner

METHOD AND APPARATUS FOR GENERATING FLUID PRESSURE PULSES

BACKGROUND

The present invention relates to the field of well stimulation; more particularly, the present invention relates to the field of well stimulation through the application of hydromechanically generated fluid pressure pulses.

The oilfield services industry has long recognized the benefit of reducing fluid pressure pulses in a well. The inducement of such pressure pulses may result in enhanced well cleaning, more efficient placement of chemicals, and improved production of desirable fluids. Experiments conducted by Wavefront Energy and Environmental Services, Inc. have shown that pressure pulses having certain characteristics, such as low frequencies, short rise times, and slow decay rates, are optimal for applications such as chemical placement in a well bore matrix and waterflood recovery. A number of tools can be used to generate varying pressure gradients downhole and could be used to generate fluid pressure pulses in a well. Many tools currently in use, however, are sized to fit within well casing or openhole wells and cannot pass through the narrower inner diameters of tubing such as coiled tubing. Moreover, many tools currently in use operate at typical mud motor speeds, rather than at the slower speeds that are more likely to result in optimal pressure pulses.

SUMMARY

The present invention relates to the field of well stimulation; more particularly, the present invention relates to the field of well stimulation through the application of hydromechanically generated pressure pulses.

We disclose multiple embodiments of apparatuses and methods for generating fluid pulses. One embodiment of an apparatus for generating fluid pulses may include a chamber that can collect fluid. The embodiment of the apparatus may also include an upstream ported disc coupled to a downstream end of the chamber. The upstream ported disc may rotate about a central axis through its width. The upstream ported disc may include an upstream eccentric port that rotates about the central axis as the upstream ported disc rotates. The embodiment of the apparatus may also include a downstream ported disc coupled to a downstream end of the upstream ported disc such that the downstream ported disc remains substantially rotationally fixed relative to the upstream ported disc. The downstream ported disc may include a downstream eccentric port. The downstream eccentric port may align with the upstream eccentric port to form a passageway for fluid to exit from the chamber, through the upstream port, and through the downstream eccentric port to outside of the apparatus, at some time in a rotation cycle of the upstream ported disc.

An alternative embodiment of an apparatus for generating fluid pulses may include a fluid source and a shaft coupled to the fluid source. The shaft may rotate. The embodiment of the apparatus may also include a case that encloses the shaft and a chamber located within the shaft. The chamber can collect fluid from the fluid source. The embodiment of the apparatus may also include an upstream ported disc located downstream of the chamber relative to the fluid source. The upstream ported disc may be coupled to the shaft such that the upstream ported disc may rotate about a central axis through its width as the shaft rotates. The embodiment of the apparatus may further include an upstream eccentric port located on the upstream ported disc. The upstream eccentric port may rotate the central axis of the upstream ported disc as the upstream ported disc rotates. Also, the embodiment of the apparatus may include a downstream ported disc located downstream of the upstream ported disc relative to the fluid source. The downstream ported disc may be coupled to the upstream ported disc such that the downstream ported disc remains substantially rotationally fixed relative to the upstream ported disc. The embodiment of the apparatus may also include a downstream eccentric port located on the downstream ported disc. The downstream eccentric port may align with the upstream eccentric port to form a passageway for fluid exiting from the chamber through the upstream eccentric port at some point in the rotation of the upstream ported disc. A cap may be coupled to the case. The cap may include at least one exit port that allows fluid to pass from the downstream eccentric port through the cap to outside of the apparatus.

Another alternative embodiment of an apparatus for generating fluid pressure pulses may include a fluid source and a shaft coupled to the fluid source. The shaft may rotate. The shaft may also include a first eccentric port that rotates as the shaft rotates. A chamber may be located within the shaft. The chamber can collect fluid from the fluid source. Fluid may exit from the chamber through the first eccentric port on the shaft. A case may enclose the shaft. The case may include a second eccentric port that may align with the first eccentric port to form a passageway for fluid exiting from the chamber through the first eccentric port at some point in the rotation of the shaft.

One embodiment of the method for generating wave pulses includes storing fluid from a fluid source in a chamber, and releasing stored fluid into the formation when an upstream eccentric port on an upstream ported disc coupled to the chamber rotates such that the upstream eccentric port aligns with a downstream eccentric port on a downstream ported disc coupled to the upstream ported disc, thereby generating a fluid pressure pulse that enters the formation.

The features and advantages of the present invention will be readily apparent to those skilled in the art upon a reading of the description of the preferred embodiments that follows.

DRAWINGS

A more complete understanding of the present disclosure and advantages thereof may be acquired by referring to the following description taken in conjunction with the accompanying drawings, wherein.

Figure 1:
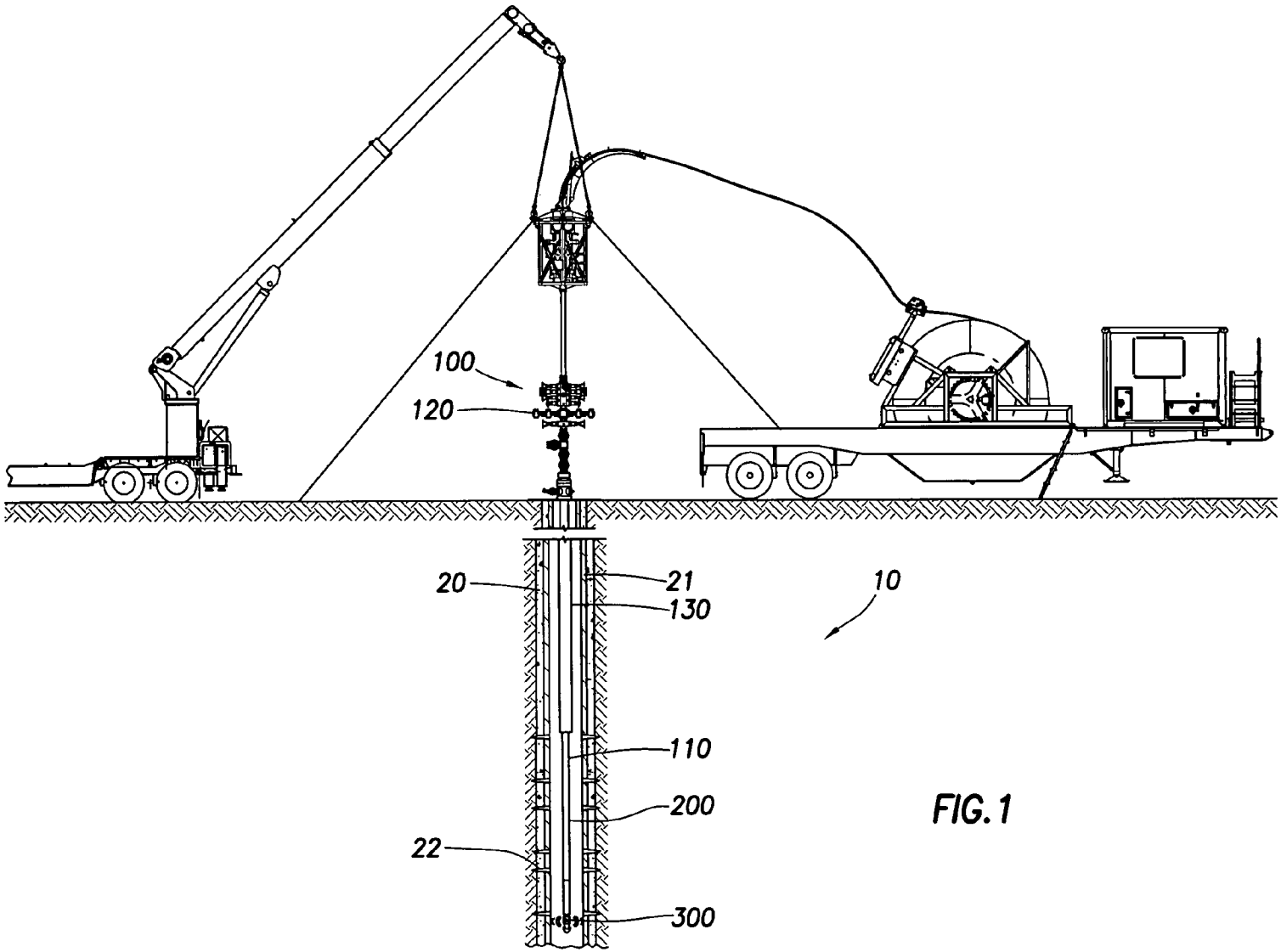
FIG. 1 illustrates a schematic view of a work string in a well.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION

The present invention relates to the field of well stimulation; more particularly, the present invention relates to the field of well stimulation through the application of hydromechanically generated pressure pulses. To facilitate a better understanding of the present invention, the following examples of preferred embodiments are given. In no way should the following examples be read to limit, or define, the scope of the invention.

FIG. 1 illustrates a formation 10 containing a deposit of a desirable fluid such as oil or natural gas. A well 20 may be drilled at well site 100 into formation 10 to extract this fluid. Well 20 may be any type of well suitable for formation 10, including an injection well. Although FIG. 1 illustrates a vertical well, well 20 may assume any configuration, including a horizontal configuration. A Christmas tree 120 may be located at well site 100. A drilling rig, workover rig, coiled tubing unit, or similar equipment may be deployed at the site. Coiled tubing 110 may go through Christmas tree 120 to form a well workstring in the well bore. Alternatively, or in addition, jointed tubing, drill pipe, or any other similar equipment, as necessary, may be used to form a well workstring. For example, Christmas tree 120 may also couple to production tubing 130, as shown in FIG. 1. Well 20 may be lined with perforated production casing 21; perforations 22 may extend into the formation for fluid extraction. Moreover, although FIG. 1 depicts well 20 as land-based, well 20 may also be an off-shore well if formation 10 is a subsea formation.

As shown generally in FIG. 1, coiled tubing 110 may couple to a slow-rotating apparatus 200 for use in downhole applications. The term "couple" or "couples" used herein is intended to mean either a direct or indirect connection. Thus, if a first device "couples" to a second device, that connection may be through a direct connection or through an indirect connection via other devices or connectors. Slow-rotating apparatus 200 translates high-speed motor rotation into a slow output rotation that can be utilized by downhole devices that cannot or preferably do not operate at the high speeds typically seen with downhole motors. Slow-rotating apparatus 200 provides a slow output rotation that may be more conducive to producing pressure pulses that are optimal for such applications as chemical placement and waterflood recovery. An example slow rotating apparatus 200 may provide torque at approximately 1 revolution per minute to approximately 100 revolutions per minute, when the source of rotation in the slow-rotating apparatus, such as the downhole motor, operates at speeds in excess of approximately 600 revolutions per minute.

An example slow-rotating apparatus is disclosed in U.S. Pat. No. 6,336,502, entitled "Slow Rotating Tool with Gear Reducer," and assigned to the assignee of this disclosure. That patent discloses a slow-rotating apparatus that can reduce the speed output of a mud motor operating at 1,000 revolutions per minute ("rpm") to only 22.2 rpm. The instant disclosure does not rely upon using the particular slow-rotation tool described in U.S. Pat. No. 6,336,502 because, as persons of ordinary skill in the art having the benefit of this disclosure will realize, other well-known slow-rotation tools could be substituted. For example, coiled tubing 110 may alternatively couple to a downhole motor, such as a mud motor, the rpm of which may be adjusted to a suitably slow speed via adjustments to the mud-flow rate and/or the use of chokes.

As FIG. 1 illustrates generally, a pressure-pulsing tool 300 may couple to slow-rotation tool 200. Pressure-pulsing tool 300 may take the place of the output section that ordinarily forms part of slow-rotation tool 200. Thus, although this detail is not shown in FIG. 1, pressure-pulsing tool 300 may couple to an output shaft that forms part of slow-rotation tool 200. The torque output of slow-rotation tool 200 can therefore be used to power pressure-pulsing tool 300, as will be discussed in more detail later in this disclosure.

Figure 2:
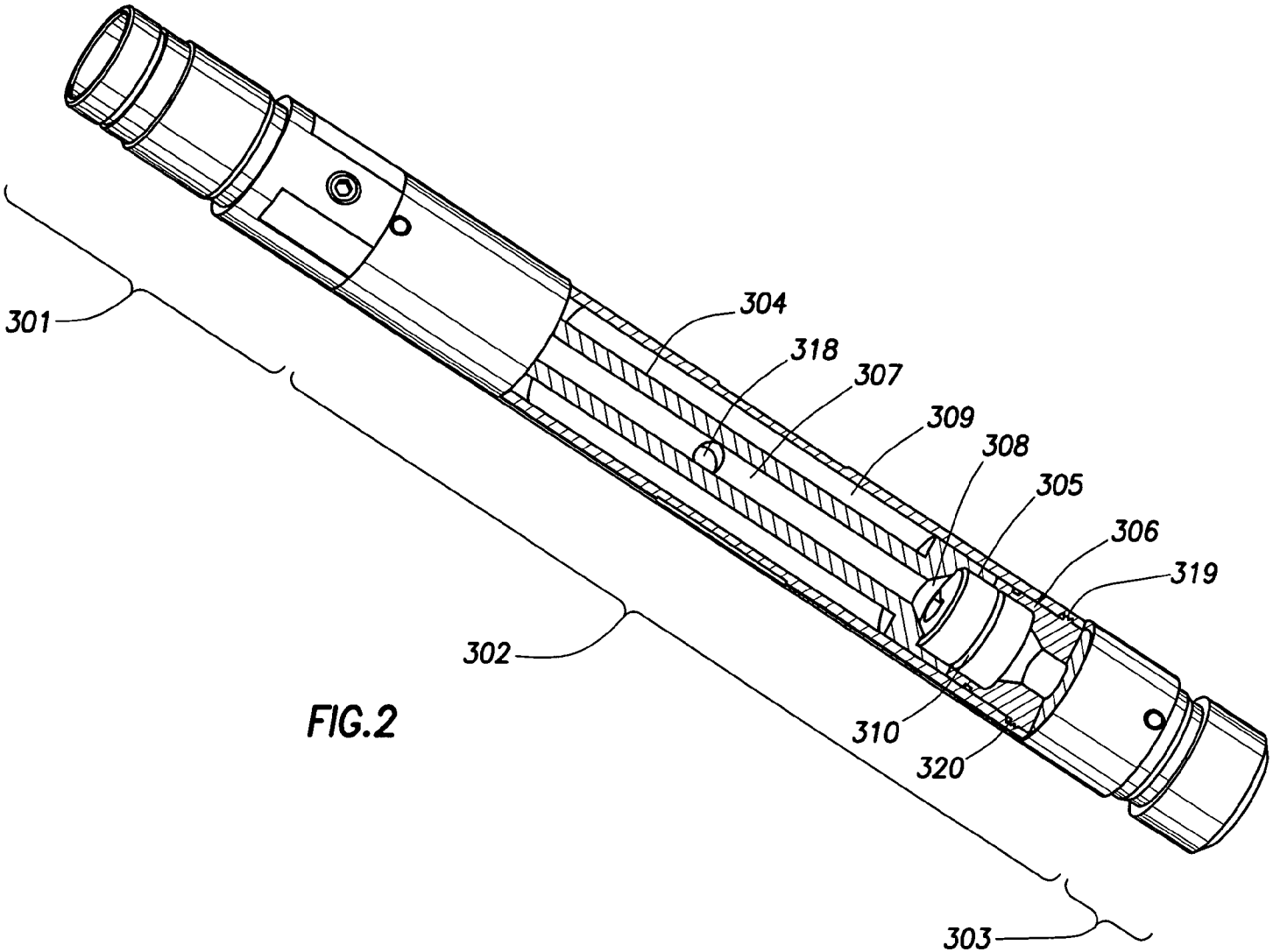
FIG. 2 illustrates a schematic of an example pressure-pulsing tool, with part of its housing removed to expose the pressure-pulsing tool's contents.

FIG. 2 shows a schematic illustration of an example pressure-pulsing tool 300. Pressure-pulsing tool 300 may include a double-pin adapter 301. Double-pin adapter 301 may couple to a case 302, which may serve as an enclosure for the majority of pressure-pulsing tool 300. A cap 303 may couple to case 302. A portion of case 302 has been removed to reveal an extension shaft 304, an upstream ported disc 305, and a downstream ported disc 306. Extension shaft 304 may include a chamber 307 through its central longitudinal axis. Chamber 307 has a downstream exit 308. Upstream ported disc 305 and downstream ported disc 306 may sit downstream of chamber 307 but upstream of cap 303.

Figure 3:
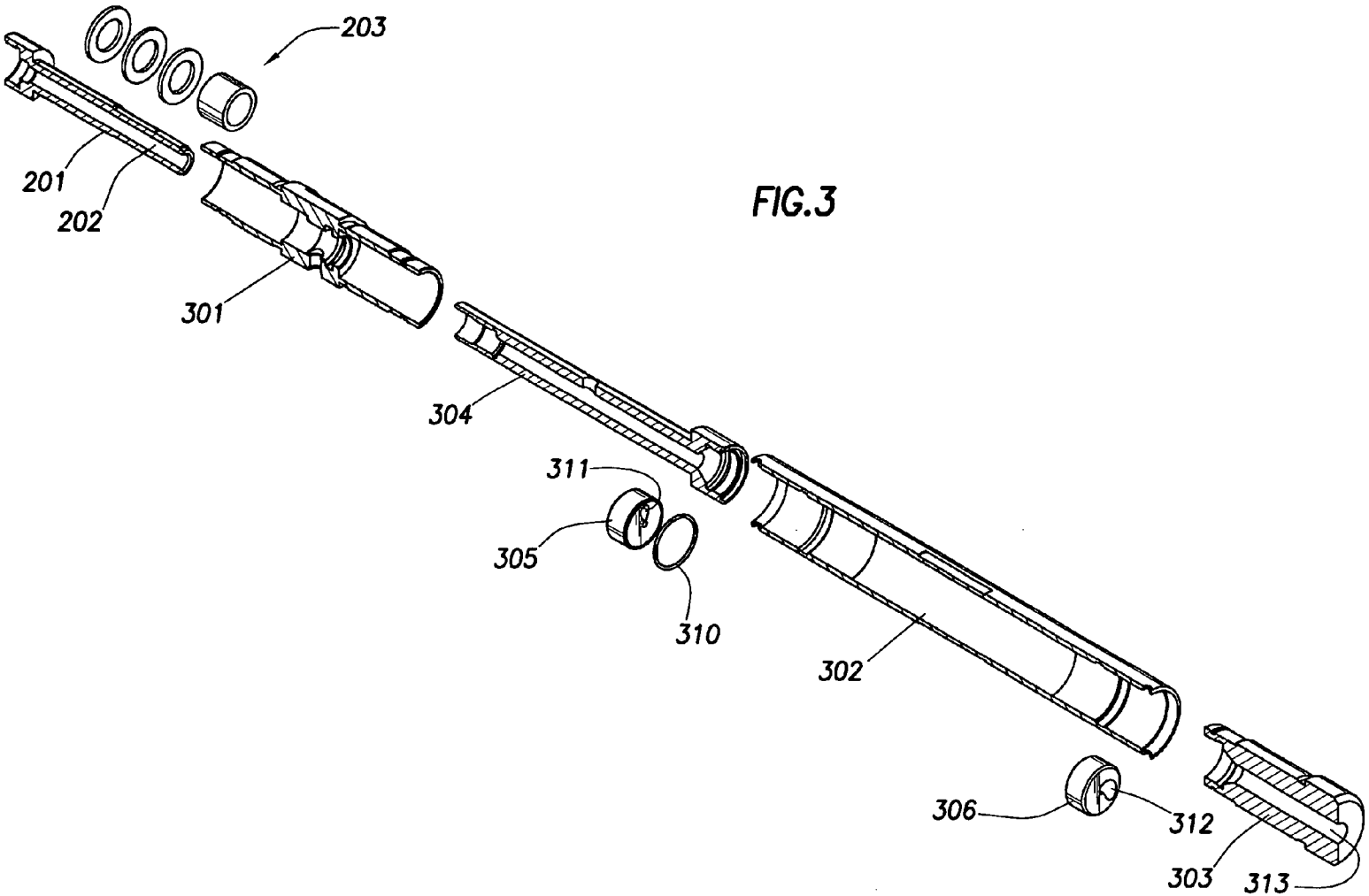
FIG. 3 illustrates an exploded, schematic view of an example pressure-pulsing tool.

FIG. 3 provides an "exploded" schematic illustration of pressure-pulsing tool 300, showing the components of pressure-pulsing tool 300 separated from, but in correct relationship to, each other. FIG. 3 thus illustrates double-pin adapter 301, case 302, cap 303, extension shaft 304, upstream ported disc 305, downstream ported disc 306, and chamber 307. To better demonstrate the relationship between slow-rotation tool 200 and pressure-pulsing tool 300, FIG. 3 also illustrates an output shaft 201 of slow-rotation tool 200. Output shaft 201 may include a passage 202 that is centered in output shaft 201 such that the central longitudinal axis of passage 202 is equivalent with the central longitudinal axis of output shaft 201. Double-pin adapter 301 may couple output shaft 201 to extension shaft 304. Double-pin adapter 301 may therefore include seats to accommodate any ridges on the outer surfaces of output shaft 201 and extension shaft 304, as well as to accommodate any O-rings or bearings (denoted generally in FIG. 3 by the numeral 203) that may be necessary to form a fluid-tight seal between double-pin adapter 301, output shaft 201, and extension shaft 304. Extension shaft 304 may rotate freely within case 302; thus as output shaft 201 of slow-rotation tool 200 rotates, extension shaft 304 rotates as well. Case 302, however, may remain rotationally fixed relative to extension shaft 304 and output shaft 201.

Again, extension shaft 304 may include a chamber 307. Chamber 307 may be in fluid communication with passage 202 in output shaft 201 such that fluid driving the mud motor in slow-rotation tool 200 may also flow through passage 202 into chamber 307. Chamber 307 acts as a reservoir for this fluid, which may ultimately be used to generate the pressure pulse. As we discuss later in this disclosure, however, coiled tubing 110 or other equipment at well site 100 may act as accumulators for fluid used to generate pulses. Chamber 307 is preferably aligned with passage 202 such that they share a central longitudinal axis. As shown in FIGS. 2 and 3, extension shaft 304 may include a vent 318. Vent 318 allows fluid to exit from chamber 307 into a void 309 between the outer surface of extension shaft 304 and the inner surface of case 302. (Void 309 is best illustrated in FIG. 2.) Vent 318 may be necessary to prevent fluid lock that could stall the rotation of extension shaft 304. However, if a relatively small amount of fluid is allowed to flow continuously through pressure-pulsing tool 300, vent 318 may be unnecessary. We discuss a feature for generating such continuous flow later in this disclosure.

If vent 318 is present, void 309 will also add to the volume of 307 to form a greater fluid column in which fluid may collect. As discussed earlier in this disclosure, the sought-after pressure pulses rely not on a high flow rate, but instead on a volume displacement of fluid that exploits the elasticity of materials in the well equipment to generate the pressure pulses. An increase in the fluid-column size will produce a corresponding increase in the pressure-pulse amplitude. Upstream ported disc 305 and downstream ported disc 306 sit at the downstream end of chamber 307. Upstream ported disc 305 couples to extension shaft 304 such that upstream ported disc 305 may rotate with extension shaft 304 and thus may rotate with output shaft 201. However, like case 302, downstream ported disc 306 remains rotationally fixed relative to extension shaft 304 and output shaft 201. To reduce any friction that may develop between upstream ported disc 305 and downstream ported disc 306, a bearing ring 310 may be provided to separate the two valves.

As shown in FIG. 3, an example upstream ported disc 305 may include an upstream eccentric port 311. As upstream ported disc 305 rotates, upstream eccentric port 311 may rotate about the center point of upstream ported disc 305. This center point of upstream ported disc 305 preferably is aligned with the central longitudinal axis of chamber 307. Again, upstream ported disc 305 may sit at the downstream end of chamber 307, which collects fluid from output shaft 201 and extension shaft 304. Upstream ported disc 305 should preferably be located relative to extension shaft 304 such that upstream eccentric port 311 aligns with downstream exit 308 of chamber 307. Fluid may therefore escape from chamber 307 through upstream eccentric port 311 at any time upstream eccentric port 311 is free from obstruction. However, different regions of downstream exit 308 will be exposed as upstream eccentric port 311 rotates.

An example downstream ported disc 306 may include a downstream eccentric port 312, as shown in FIG. 3. As with upstream ported disc 305, the center point of downstream ported disc 306 preferably aligns with the central longitudinal axis of chamber 307 and therefore preferably aligns with the center point of upstream ported disc 305. Because downstream ported disc 306 remains rotationally fixed, downstream eccentric port 312 also remains fixed. Downstream ported disc 306 may sit directly downstream of upstream ported disc 305 relative to fluid flow through slow-rotating apparatus 200 into chamber 307. Thus, fluid draining from chamber 307 through upstream eccentric port 311 may next encounter downstream ported disc 306. Except for a relatively small amount of constant fluid flow which may be necessary to drive the motor, as discussed below, the bulk of the fluid may flow into downstream ported disc 306 only when upstream eccentric port 311 passes over downstream eccentric port 312, as discussed in more detail later in this disclosure. As a person of ordinary skill in the art will realize, in some example pressure-pulsing tools 300, downstream ported disc 306 may rotate, while upstream ported disc remains substantially rotationally fixed relative to the downstream ported disc.

Cap 303 may sit at the end of pressure-pulsing tool 300, downstream from downstream ported disc 306. Cap 303 may include an exit port 313 that runs through the full length of cap 303, providing an exit for fluid to pass from cap 303 to outside of pressure-pulsing tool 300. Exit port 313 may be aligned such that fluid may pass from downstream eccentric port 312 into exit port 313. Thus, when upstream eccentric port 311 rotates such that fluid may pass through it into downstream eccentric port 312, the fluid will also be able to pass from downstream eccentric port 312 through exit port 313 and out of pressure-pulsing tool 300.

Pressure pulsing tool 300 may be used to generate pressure pulses as desired for formation stimulation as follows. As output shaft 201 of slow-rotating apparatus 200 rotates, it may then rotate extension shaft 304. Extension shaft 304 in turn may cause upstream ported disc 305 to rotate. As upstream ported disc 305 rotates, upstream eccentric port 311 will rotate; upstream eccentric port 311 will therefore rotate above downstream eccentric port 312. Until upstream eccentric port 311 and downstream eccentric port 312 are aligned such that fluid may pass from upstream eccentric port 311 into downstream eccentric port 312, fluid will build up not only in chamber 307 and void 309 but also throughout slow-rotation tool 200, coiled tubing 110, and other equipment at well site 100 that is above downstream ported disc 306 and in the fluid flowline. Once upstream eccentric port 311 aligns with downstream eccentric port 312, the column of fluid stored in the well equipment above downstream ported disc 306, including slow-rotation tool 200, coiled tubing 110, and other equipment at well site 100 that is in the fluid flowline, will drain through downstream eccentric port 312. The longer upstream eccentric port 311 and downstream eccentric port 312 remain aligned, the greater the proportion of the fluid in large fluid column that may drain through exit port 313 and exit pressure-pulsing tool 300 as a single fluid dump. However, if upstream eccentric port 311 does not align with downstream eccentric port 312 for very long, a smaller fluid volume will exit pressure-pulsing tool 300. In most wells, this volume of fluid should be sufficient to generate the needed pressure pulse.

The rotation of upstream ported disc 305 will gradually move upstream eccentric port 311 such that it no longer aligns with downstream eccentric port 312. Fluid may again build up in chamber 307, void 309, and the rest the well equipment, including slow-rotation tool 200, coiled tubing 110, and all other equipment at well site 100 above downstream ported disc 306. Pressure pulsing tool 300 may then dump this fluid once upstream eccentric port 311 is realigned with downstream eccentric port 312. Again, because the pressure pulses are generated by a fluid volume dump, rather than a high speed fluid jet, a low rotation speed for upstream ported disc 305 may be preferred. Similarly, because the pressure pulses are independent of fluid flow rate, pressure pulsing tool 300 may operate over a large range of fluid flow rates.

Figure 4:
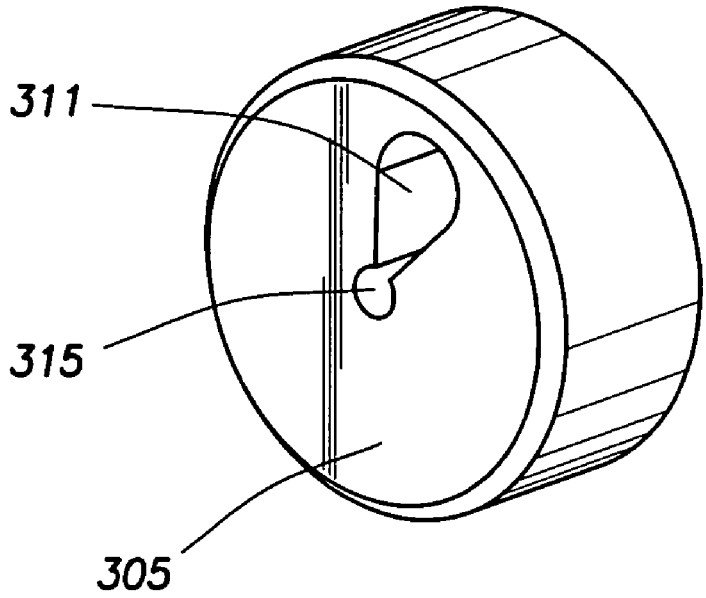
FIG. 4 illustrates a schematic view of an example upstream ported disc.
Figure 5:
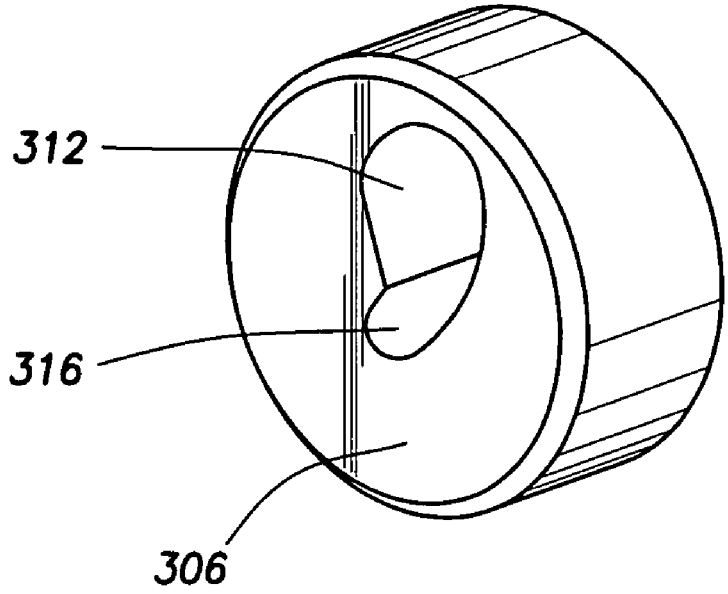
FIG. 5 illustrates a schematic view of an example downstream ported disc.

The shapes of upstream eccentric port 311 and downstream eccentric port 312 is best revealed in FIGS. 4 and 5, which depict upstream ported disc 305 and downstream ported disc 306, respectively. The eccentric shapes of upstream eccentric port 311 and downstream eccentric port 312 shown in these figures allow for a quick fluid dump to give a strong pressure pulse, while allowing for a slow pressure pulse decay rate and low frequency. Upstream eccentric port 311 and downstream eccentric port 312 may assume forms other than the shapes depicted in FIGS. 4 and 5, however, and still function as desired in pressure-pulsing tool 300, so long as upstream eccentric port 311 may align with downstream exit 308 and downstream eccentric port 312 such that fluid stored in chamber 307 may be released through upstream eccentric port 311 and into downstream eccentric port 312.

Figure 6:
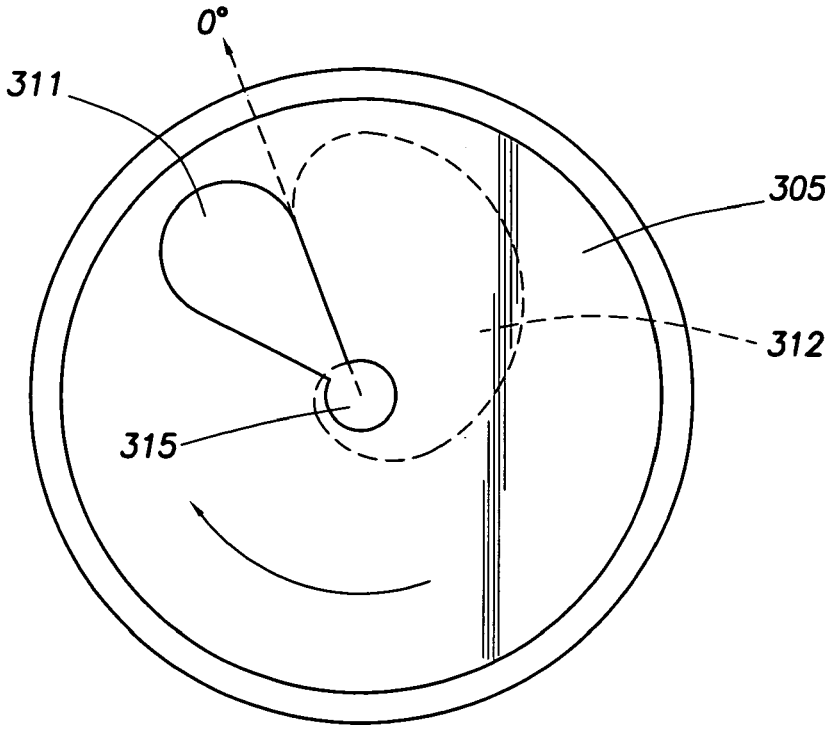
FIG. 6 illustrates a schematic view of an example upstream ported disc overlaying an example downstream ported disc such that a port on the example upstream ported disc does not align with a port on the example downstream ported disc.
Figure 7:
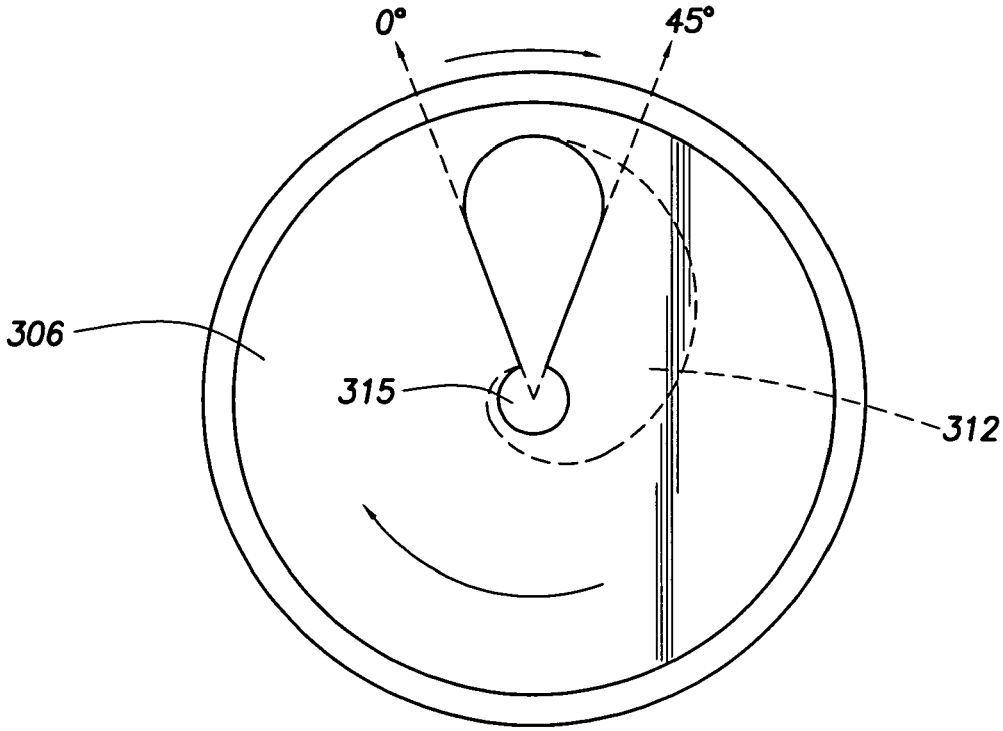
FIG. 7 illustrates a schematic view of an example upstream ported disc overlaying an example downstream ported disc such that a port on the example upstream ported disc aligns with a port on the example downstream ported disc.
Figure 8:
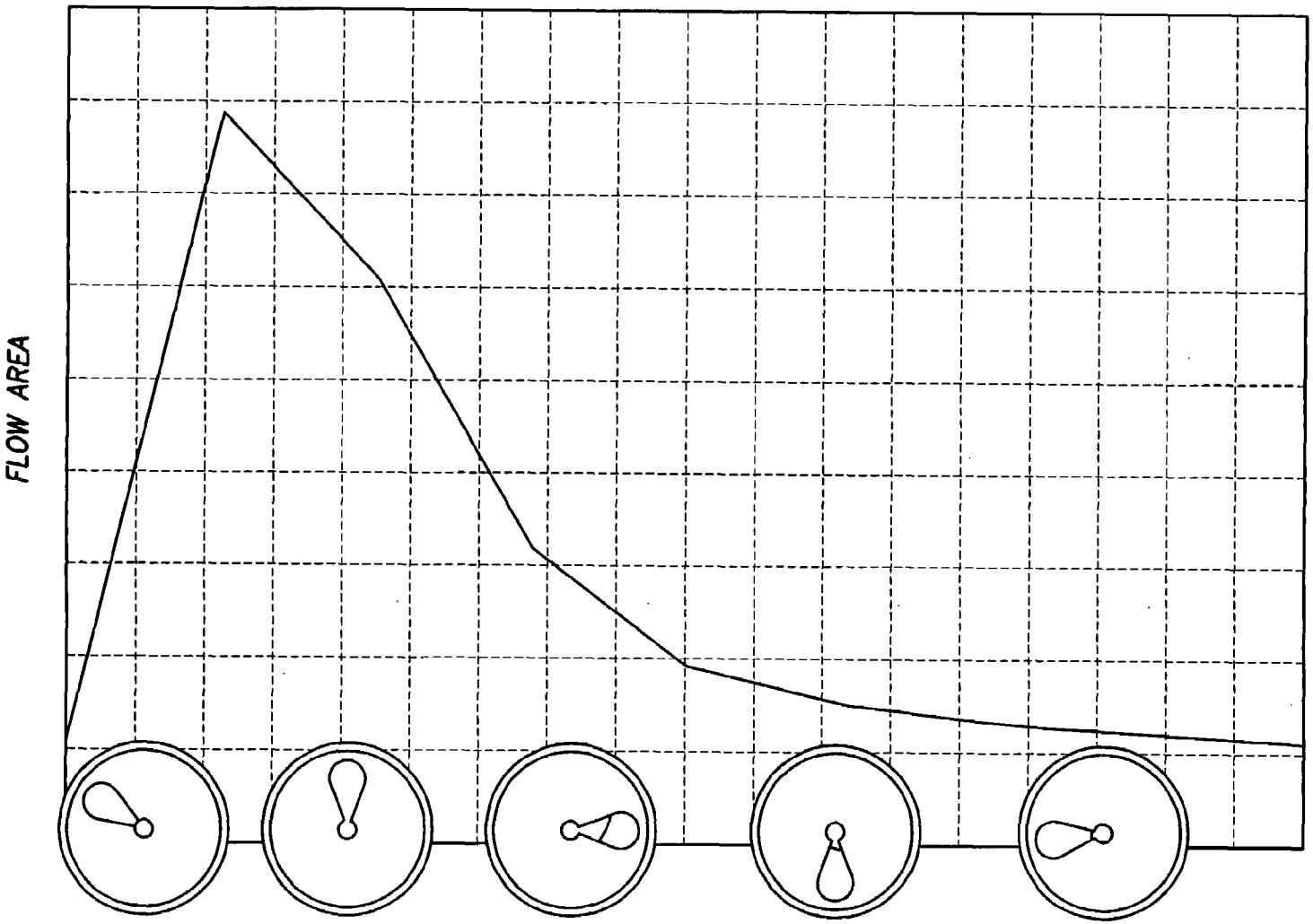
FIG. 8 illustrates a graph of changes in the area for which fluid may flow through both the upstream eccentric port and the downstream eccentric port over one period of rotation of an example upstream ported disc.
Figure 9:
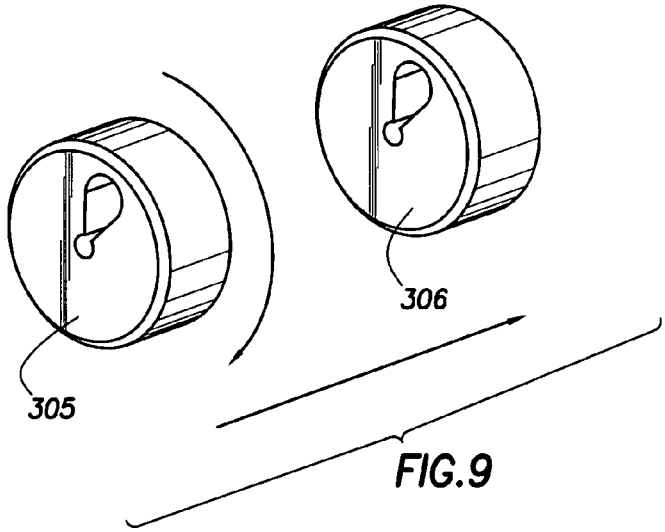
FIG. 9 illustrates one possible configuration of an upstream eccentric port and a downstream eccentric port.
Figure 10:
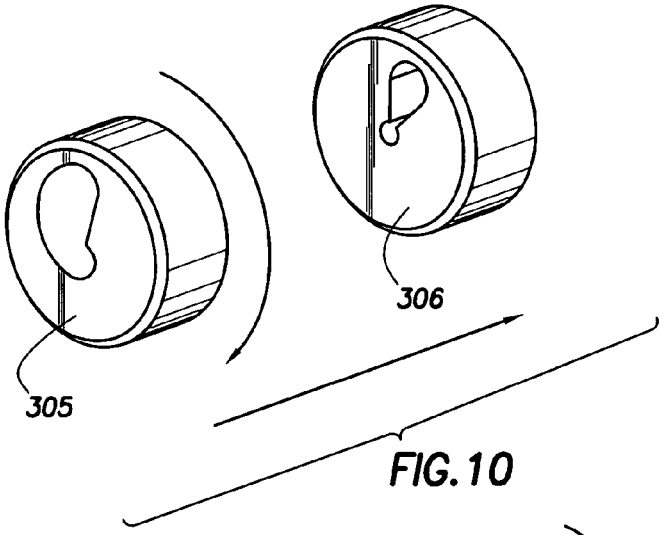
FIG. 10 illustrates one possible configuration of an upstream eccentric port and a downstream eccentric port.
Figure 11:
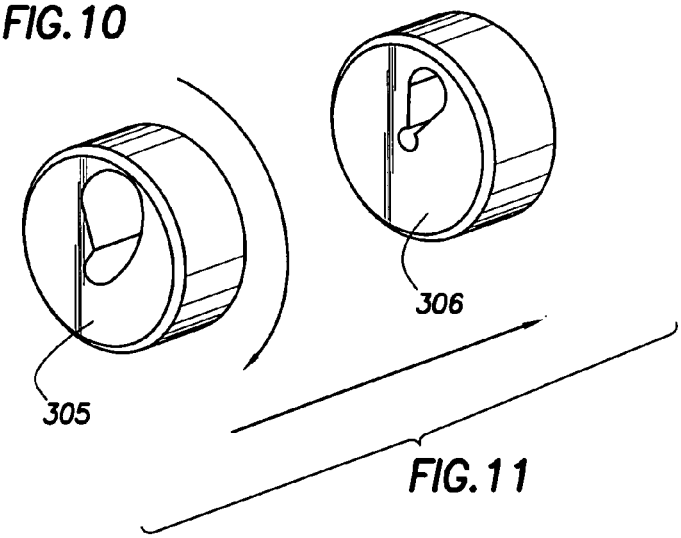
FIG. 11 illustrates one possible configuration of an upstream eccentric port and a downstream eccentric port.
Figure 12:
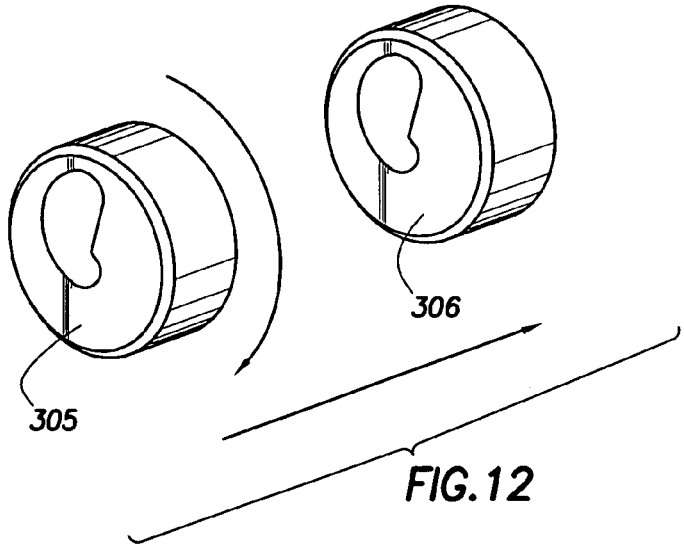
FIG. 12 illustrates one possible configuration of an upstream eccentric port and a downstream eccentric port.
Figure 13:
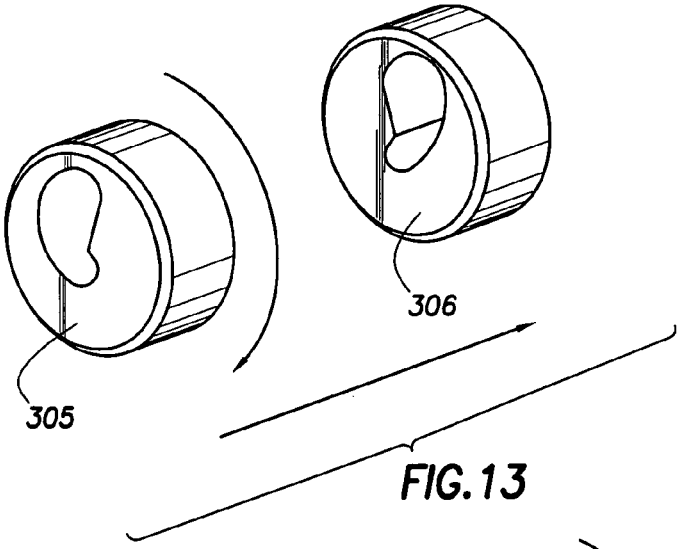
FIG. 13 illustrates one possible configuration of an upstream eccentric port and a downstream eccentric port.
Figure 14:
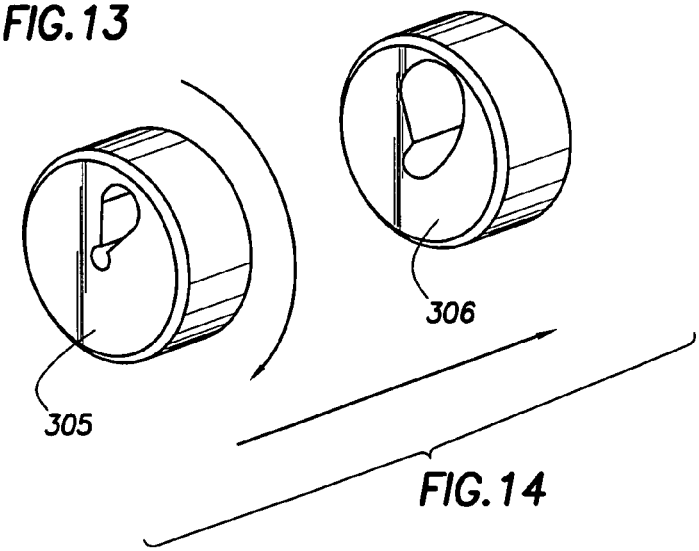
FIG. 14 illustrates one possible configuration of an upstream eccentric port and a downstream eccentric port.

FIG. 6 illustrates schematically the alignment of upstream eccentric port 311 with downstream eccentric port 312, whose footprint is depicted by the dashed line, at one instance in the rotation of upstream ported disc 305. FIG. 7 illustrates schematically the alignment of upstream eccentric port 311 with downstream eccentric port 312, at an instance in the rotation of upstream ported disc 305 after the instance depicted in FIG. 6. For the eccentric ports shown in FIGS. 6 and 7, fluid will flow through downstream eccentric port 312 through approximately 333 degrees of the rotation of upstream ported disc 305. FIG. 8 illustrates graphically the change in the area through which fluid may flow as upstream ported disc 305 rotates over downstream ported disc 306. The fluid flow area is plotted on the vertical axis against one period of rotation of upstream ported disc 305 on the horizontal axis. The positions of upstream eccentric port 311 over downstream eccentric port 312 through a single rotation period are also illustrated along the horizontal axis of the graph in FIG. 8. As upstream eccentric port 311 aligns with downstream eccentric port 312, the area through which fluid may flow increases, as shown in the graph. The volume fluid pulse will increase accordingly and taper off as upstream eccentric port 311 rotates away from downstream eccentric port 312. The flow area will not drop to zero because of a small amount of continuous fluid flow may be needed to drive slow-rotation tool 200, as discussed later in the application.

Should other shapes for the eccentric ports be used, fluid may flow through downstream eccentric port 312 for a different proportion of the rotation of upstream ported disc 305, resulting in a different fluid pulse. FIGS. 9, 10, 11, 12, 13, and 14 illustrate a sampling of possible configurations for upstream eccentric port 311 and downstream eccentric port 312. The shapes of the ports shown in these figures are but a few of the many viable configurations. Experiments have shown that the configuration shown in FIG. 14 may best generate fluid pulses with short rise times and slow decay rates.

Experiments have shown that pressure pulses on the order of about 1,000 psi to about 1,200 psi over an annulus pressure of about 2,500 psi are possible using a tool such as pressure-pulsing tool 300. Experiments have also shown success in generating pressure pulses on the order of about 1,000 psi to about 1,300 psi over an annulus pressure of about 750 psi using a tool such as pressure-pulsing tool 300. The form, frequency, and amplitude of the pressure pulse may be varied by making several adjustments to the components of pressure pulsing tool 300. The speed at which upstream ported disc 305 rotates can be adjusted to reduce the frequency of the pressure pulses. For example, some wells may best be stimulated by pressure pulses that occur about once every three seconds; to achieve this period, the rotation speed for upstream ported disc 305 can be set at approximately 20 rpm. Likewise, this rotation speed will also affect the form of the pressure pulse. A faster rotation speed will lead to a shorter pulse period, with a correspondingly lesser rise time and amplitude. In essence, the entire form of the pressure pulse may change. Cap 303 may couple to case 302 such that it can be tightened against downstream ported disc 306 as desired. For example, as shown in FIG. 2, cap 303 may include male threads 319 that allow cap 303 to be screwed into corresponding female threads 320 in case 302. The faces of the two valves mate such that the tighter cap 303 is coupled to case 302, the smaller the fluid bypass through downstream ported disc 306 is. Thus, the amplitude of the pressure pulses can be adjusted by tightening or loosening cap 303; the tighter cap 303 is against downstream ported disc 306, the greater the pressure of the resulting pressure pulse.

Upstream ported disc 305 and downstream ported disc 306 may each include a flow release that allows a relatively small amount of fluid to flow continuously from chamber 307 through upstream ported disc 305 and downstream flow 306. An upstream flow release 315 may therefore be located at the center point of upstream ported disc 305, and a downstream flow release 316 may be located at the center point of downstream ported disc 306, as shown in FIGS. 4 and 5. Both upstream flow release 315 and downstream flow release 316 may be contiguous with upstream eccentric port 311 and downstream eccentric port 312. Upstream flow release 315 and downstream flow release 316 preferably align such that they form a permanently open fluid pathway to chamber 307. Upstream flow release 315 and downstream flow release 316 should also preferably align with exit port 313 so that fluid passing through upstream flow release 315 and downstream flow release 316 may exit pressure-pulsing tool 300 altogether.

Figure 15:
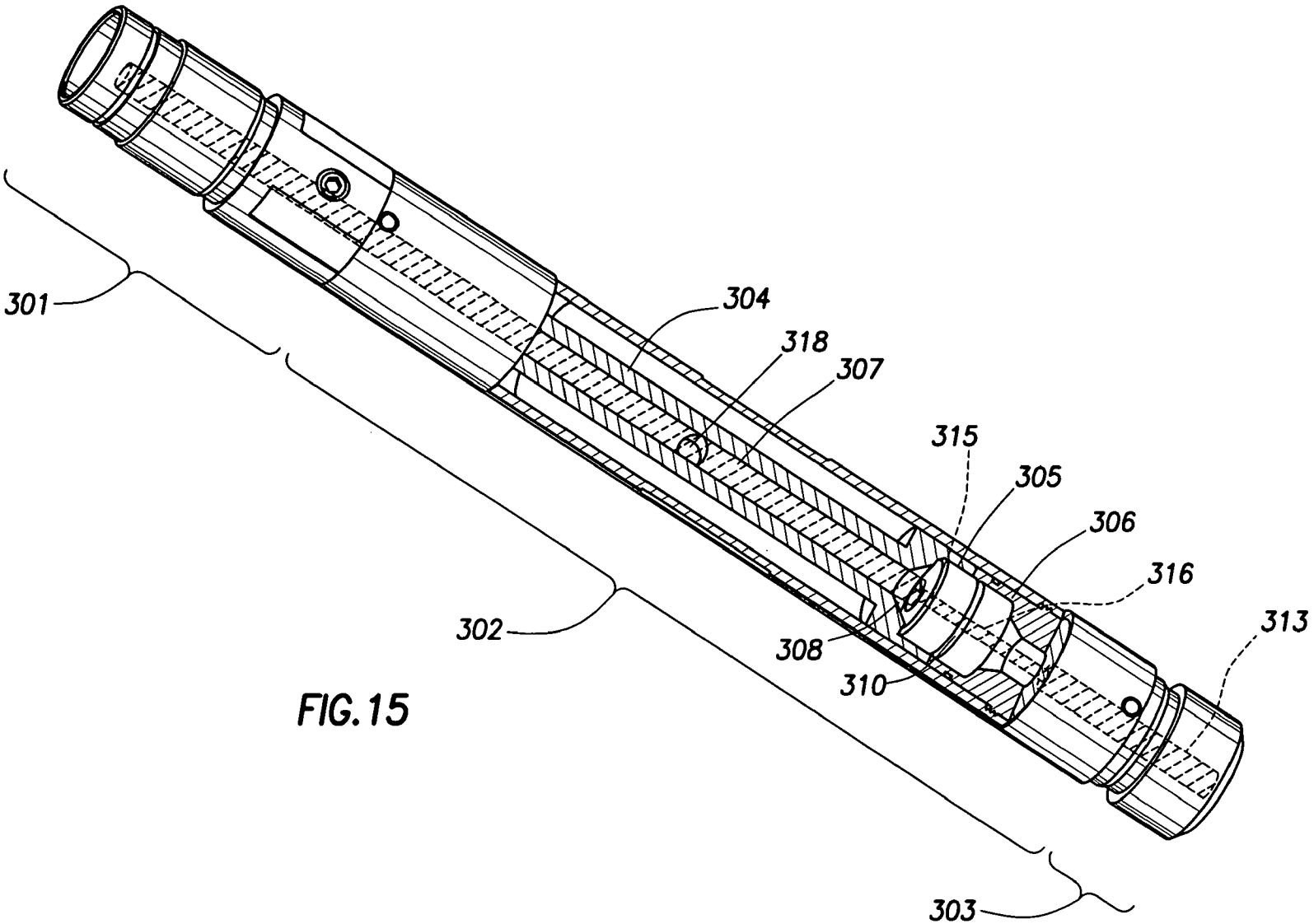
FIG. 15 illustrates a schematic, cutaway view of an example pressure-pulsing tool.

Ultimately, a permanent fluid passageway may be created from output shaft 201 of slow-rotating tool 200, through chamber 307 in extension shaft 304, through upstream flow release 315 in upstream ported disc 305, through downstream flow release 316 in downstream ported disc 306, and finally, through exit port 313 in cap 303, to outside of pressure-pulsing tool 300 altogether. This permanent passageway is shown the cutaway view of pressure-pulsing tool 300 illustrated in FIG. 15; the shaded area represents the permanent passageway. This permanent passageway may be necessary for the operation of slow-rotating tool 200, and ultimately, for the operation of pressure-pulsing tool 300; without constant exposure to moving fluid, the rotor of the mud motor in slow-rotating tool 200 will not rotate and will not generate the torque needed to run pressure-pulsing tool 300. The need for constant fluid flow from slow-rotating tool 200 through pressure-pulsing tool 300 must be balanced, however, with the need to build a reserve of fluid in chamber 307 in order to generate the desired pressure pulse. Thus, both upstream flow release 315 and downstream flow release 316 would preferably be much smaller than upstream and downstream eccentric ports 311 and 312, to ensure that only a relatively small volume of fluid is continuously draining through upstream flow release 315 and downstream flow release 316.

Figure 16:
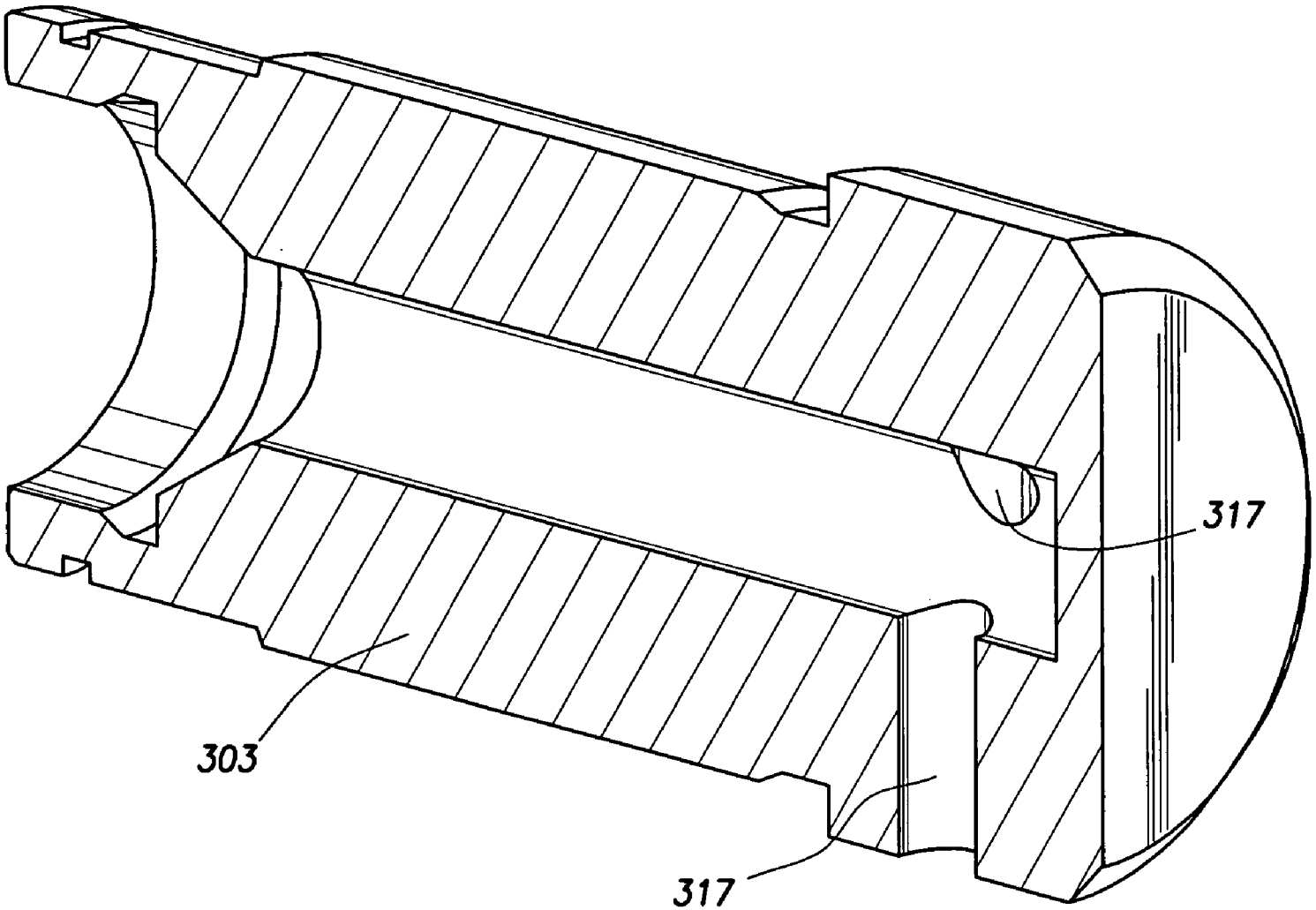
FIG. 16 illustrates a schematic view of an example end cap for an example pressure-pulsing tool.

FIG. 16 illustrates an alternative example of cap 303, with at least one side port 317, instead of, or in addition to, exit port 313. Side port 317 exits pressure-pulsing tool 300 through a longitudinal side of cap 303. With side port 317, fluid pulses can be more directly applied to an area of the formation surrounding cap 303. As discussed previously in this disclosure, however, the pressure pulses will not be localized to only the immediate area surrounding well 20, but instead will travel some distance into formation 10.

Figure 17B:
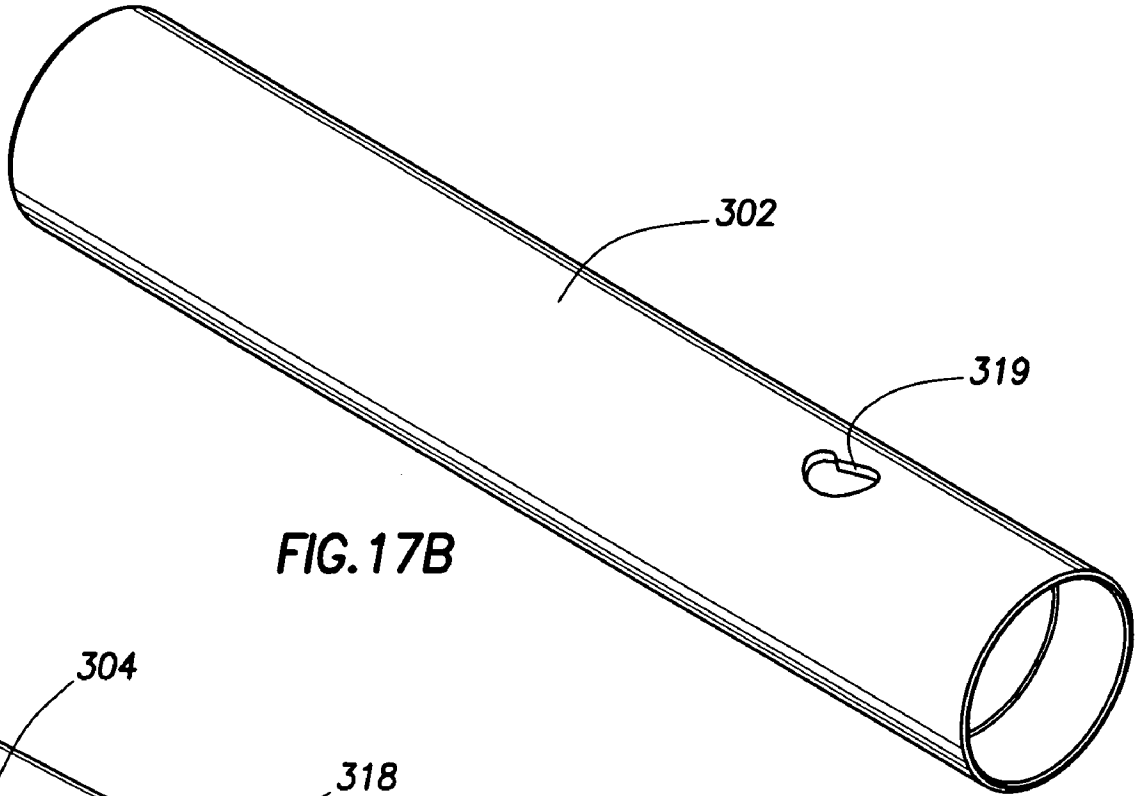
FIG. 17B illustrates a schematic view of a portion of an example pressure-pulsing tool.
Figure 17A:
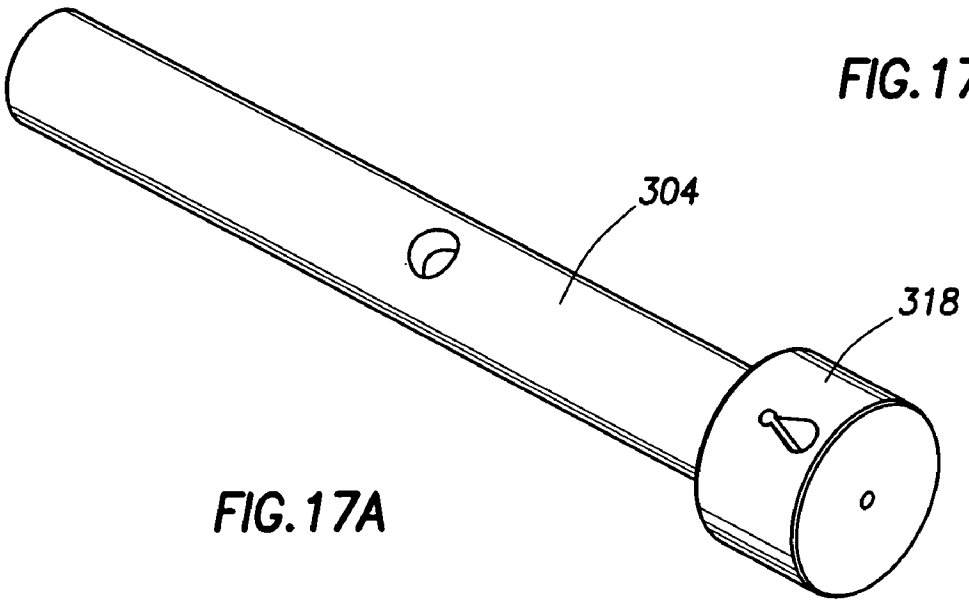
FIG. 17A illustrates a schematic view of a portion of an example pressure-pulsing tool.

An example pressure-pulsing tool 300 may alternatively dispense with the upstream and downstream ported discs, and instead include a first eccentric port 318 on extension shaft 304 and a second eccentric port 319 on case 302, as shown in FIG. 17. First eccentric port 318 is in fluid connection with chamber 307. Through the course of a single rotation of extension shaft 304, first eccentric port 318 will align with second eccentric port 319. When first eccentric port 318 aligns with second eccentric port 319, fluid may be released from chamber 307 through both ports and exit from pressure-pulsing tool 300 in a fluid pulse. This design can be used to apply pressure pulses to the formation area surrounding second eccentric port 319. The various port configurations shown in FIGS. 9, 10, 11, 12, 13, and 14 can be translated to the first and second eccentric ports shown in this example pressure-pulsing tool 300, but other alternative configurations may be used.

However the ports are configured, a pressure-pulsing tool 300 may also be used to deliver a pressure spike of a treatment fluid to formation 20. The fluid forming the pressure pulses may be a treatment fluid designed to resolve a particular well-bore or reservoir-condition. Possible treatment fluids may include, but are not limited to, fluids such as water, acids, fracture proppants, and suspensions of beneficial chemicals or particulates. The desired treatment fluid may be pumped to slow-rotation tool 200 through the coiled tubing 110; the treatment fluid may then pass through output shaft 201 into expansion shaft 304. If a mud motor is used to drive output shaft 301 and expansion shaft 304, in or without slow-rotation apparatus 200, this treatment fluid may be used to drive the mud motor. As the eccentric ports align, they may release the treatment fluid in a pressure pulse that will radiate from well 20 into the surrounding formation 10.

Therefore, the present invention is well adapted to attain the ends and advantages mentioned as well as those that are inherent therein. While numerous changes may be made by those skilled in the art, such changes are encompassed within the spirit of this invention as defined by the appended claims.

What is claimed is:

1. An apparatus for generating fluid pressure pulses, comprising:

a chamber having an upstream opening, wherein the chamber can collect fluid via the opening, a vent in the chamber, wherein the collected fluid can exit the chamber through the vent, an upstream ported disc coupled to a downstream end of the chamber, wherein the upstream ported disc may rotate about a central axis through its width and wherein the upstream ported disc includes an upstream eccentric port that rotates about the central axis as the upstream ported disc rotates, and a downstream ported disc coupled to a downstream end of the upstream ported disc such that the downstream ported disc remains substantially rotationally fixed relative to the upstream ported disc, wherein the downstream ported disc includes a downstream eccentric port that may align with the upstream eccentric port to form a passageway for fluid to exit from the chamber, through the upstream port, and through the downstream eccentric port to outside of the apparatus, at some time in a rotation cycle of the upstream ported disc.

2. The apparatus for generating fluid pressure spikes of claim 1, wherein the upstream port and downstream port are eccentrically shaped.

3. The apparatus for generating fluid pressure spikes of claim 1, further comprising a shaft coupled to the upstream ported disc, wherein rotation of the shaft results in corresponding rotation of the upstream ported disc.

4. The apparatus for generating fluid pressure pulses of claim 1, wherein the at least one exit port exits a cap on a longitudinal side of the cap.

5. The apparatus for generating fluid pressure pulses of claim 1, further comprising a well work string that couples a fluid source to the shaft, wherein the well work string may store fluid from the fluid source for release in a fluid pressure pulse.

6. An apparatus for generating fluid pressure pulses, comprising:

a chamber having an upstream opening, wherein the chamber can collect fluid via the opening, a vent in the chamber, wherein the collected fluid can exit the chamber through the vent, an upstream ported disc coupled to a downstream end of the chamber, wherein the upstream ported disc includes an upstream eccentric port, and a downstream ported disc coupled to a downstream end of the upstream ported disc such that the downstream ported disc may rotate about a central axis through its width and wherein the downstream ported disc includes a downstream eccentric port that may align with the upstream eccentric port to form a passageway for fluid to exit from the chamber, through the upstream port, and through the downstream eccentric port to outside of the apparatus, at some time in a rotation cycle of the downstream ported disc.

7. An apparatus for generating fluid pressure pulses, comprising:

a fluid source, a shaft coupled to the fluid source, wherein the shaft rotates, a case, wherein the case encloses the shaft, a chamber located within the shaft, wherein the chamber can collect fluid from the fluid source, a vent located in the chamber; wherein the collected fluid can exit the chamber through the vent, an upstream ported disc located downstream of the chamber relative to the fluid source, wherein the upstream ported disc is coupled to the shaft such that the upstream ported disc may rotate about a central axis through its width as the shaft rotates, an upstream eccentric port located on the upstream ported disc, wherein the upstream eccentric port rotates the central axis of the upstream ported disc as the upstream ported disc rotates, a downstream ported disc located downstream of the upstream ported disc relative to the fluid source, wherein the downstream ported disc is coupled to the upstream ported disc such that the downstream ported disc remains substantially rotationally fixed relative to the upstream ported disc, a downstream eccentric port located on the downstream ported disc, wherein the downstream eccentric port may align with the upstream eccentric port to form a passageway for fluid exiting from the chamber through the upstream eccentric port at some point in the rotation of the upstream ported disc, and a cap coupled to the case, wherein the cap includes at least one exit port that allows fluid to pass from the downstream eccentric port through the cap to outside of the apparatus.

8. The apparatus for generating fluid pressure pulses of claim 7, further comprising an adapter to couple the shaft to an output shaft of a means for providing torque, wherein the output shaft rotates at speeds ranging between approximately 1 rotation per minute to approximately 100 rotations per minute while the means for providing torque operates at rotations of at least approximately 600 rotations per minute.

9. The apparatus for generating fluid pressure pulses of claim 7, further comprising a fluid release on each of the upstream and downstream ported discs, wherein the fluid releases are in fluid communication with the slow-rotating apparatus and with the at least one exit port.

10. The apparatus for generating fluid pressure pulses of claim 7, wherein the cap couples to the case such that tightening the coupling between the cap and case increases the pressure of fluid pressure pulses generated by the apparatus.

11. The apparatus for generating fluid pressure pulses of claim 7, wherein the at least one exit port exits the cap on a longitudinal side of the cap.

12. The apparatus for generating fluid pressure pulses of claim 7, further comprising a bearing ring disposed between the upstream ported disc to the downstream ported disc.

13. The apparatus for generating fluid pressure pulses of claim 7, wherein the upstream eccentric port and the downstream eccentric port are geometrically configured such that a fluid pressure pulse having a short rise time and long decay period is generated when fluid is released through the at least one exit port.

14. The apparatus for generating fluid pressure pulses of claim 7, further comprising a well workstring that couples the fluid source to the shaft.

15. The apparatus for generating fluid pressure pulses of claim 14, wherein the well workstring may store fluid from the fluid source for release in a fluid pressure pulse.

16. The apparatus for generating fluid pressure pulses of claim 7, further comprising a vent in the shaft that provides fluid communication between the chamber and a void between the case and an outer surface of the shaft.

17. A method for generating a fluid pressure pulse in a formation, comprising the steps of:

storing fluid from a fluid source in a chamber, and releasing stored fluid into the formation when an upstream eccentric port rotates such that the upstream eccentric port aligns with a downstream eccentric port, thereby generating a fluid pressure pulse that enters the formation.

18. The method for generating a fluid pressure pulse in a formation of claim 17, further comprising the step of storing fluid in a well workstring coupled to the chamber.

19. The method for generating a fluid pressure pulse in a formation of claim 17, wherein the step of releasing stored fluid into the formation comprises the steps of:

draining stored fluid from the chamber into the upstream eccentric port on the upstream ported disc, rotating the upstream ported disc such that the upstream eccentric port is aligned with the downstream eccentric port on the downstream ported disc;

releasing the fluid from the downstream eccentric port into the formation through at least one exit port in a cap located downstream of downstream eccentric port relative to the fluid source.

20. The method for generating a fluid pressure pulse in the formation of claim 17, further comprising the steps of:

selecting a fluid having a composition designed to resolve a specific formation condition, and supplying the selected fluid to the fluid source.

* * * * *